US009671083B2

(12) United States Patent
Johnson

(10) Patent No.: US 9,671,083 B2
(45) Date of Patent: Jun. 6, 2017

(54) LIGHT FIXTURE WITH REFLECTIVE OPTICS

(71) Applicant: GE Lighting Solutions, LLC, East Cleveland, OH (US)

(72) Inventor: David Mark Johnson, East Flat Rock, NC (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 14/572,307

(22) Filed: Dec. 16, 2014

(65) Prior Publication Data

US 2016/0169478 A1 Jun. 16, 2016

(51) Int. Cl.

| | |
|---|---|
| ***F21V 7/00*** | (2006.01) |
| ***F21V 7/05*** | (2006.01) |
| ***F21K 9/90*** | (2016.01) |
| ***F21S 8/08*** | (2006.01) |
| ***F21V 7/09*** | (2006.01) |
| ***F21V 29/74*** | (2015.01) |
| *F21W 131/103* | (2006.01) |
| *F21Y 103/10* | (2016.01) |
| *F21Y 115/10* | (2016.01) |

(52) U.S. Cl.

CPC ..... *F21V 7/0083* (2013.01); *F21K 9/90* (2013.01); *F21S 8/086* (2013.01); *F21V 7/005* (2013.01); *F21V 7/0008* (2013.01); *F21V 7/0066* (2013.01); *F21V 7/05* (2013.01); *F21V 7/09* (2013.01); *F21V 29/74* (2015.01); *F21W 2131/103* (2013.01); *F21Y 2103/10* (2016.08); *F21Y 2115/10* (2016.08)

(58) Field of Classification Search

CPC ..... F21V 7/0083; F21V 7/0066; F21V 7/05; F21K 9/90

See application file for complete search history.

(56) References Cited

U.S. PATENT DOCUMENTS

| | | | |
|---|---|---|---|
| 5,347,259 | A | 9/1994 | Jongewaard |
| 7,556,399 | B1 | 7/2009 | Bailey |
| 8,210,706 | B2 | 7/2012 | Rooymans et al. |
| 8,708,517 | B2 | 4/2014 | Lou et al. |

(Continued)

FOREIGN PATENT DOCUMENTS

| | | |
|---|---|---|
| CA | 2118682 A1 | 9/1994 |
| EP | 2713098 A1 | 4/2014 |

(Continued)

OTHER PUBLICATIONS

European Search Report and Opinion issued in connection with corresponding EP Application No. 15197642.0 on Feb. 12, 2016.

(Continued)

*Primary Examiner* — Andrew Coughlin
*Assistant Examiner* — Meghan Ulanday
(74) *Attorney, Agent, or Firm* — GE Global Patent Operation; Peter T. DiMauro

(57) ABSTRACT

In various embodiments, there is provided a luminaire optical system that includes a first optical module and a second optical module. The first optical module includes a first reflective surface configured to output light vectors in a first direction. The second optical module includes a second reflective surface configured to reflect light vectors from the second optical module in a second direction. The first reflective surface and the second reflective surfaces are surfaces of one reflector.

15 Claims, 13 Drawing Sheets

(56) References Cited

U.S. PATENT DOCUMENTS

| | | | |
|---|---|---|---|
| 2006/0291201 | A1 | 12/2006 | Smith |
| 2008/0219002 | A1 | 9/2008 | Sommers et al. |
| 2011/0063848 | A1 | 3/2011 | Rong et al. |
| 2011/0194281 | A1 | 8/2011 | Josefowicz et al. |
| 2012/0063125 | A1 | 3/2012 | Quaal et al. |
| 2012/0134133 | A1 | 5/2012 | Kang |
| 2013/0229803 | A1 | 9/2013 | Teklak |

FOREIGN PATENT DOCUMENTS

| | | | |
|---|---|---|---|
| KR | 101448389 | B1 | 10/2014 |
| WO | 2014115460 | A1 | 7/2014 |

OTHER PUBLICATIONS

Office Action issued in connection with corresponding EP Application No. 15197642.0 on Mar. 24, 2017.

300

600

LIGHT FIXTURE WITH REFLECTIVE OPTICS

TECHNICAL FIELD

The present disclosure generally relates to a light fixture. More particularly, the present disclosure relates to a light fixture with reflective optics.

BACKGROUND

A roadway light fixture (or luminaire) may include an incandescent lamp, a high intensity discharge (HID) lamp, or one or more banks of light-emitting diodes (LEDs). The luminaire may include a reflector and a lens that cooperatively function to illuminate specific parts of the roadway. Traditionally, the reflector may have included several disjointed sections that were placed at specific locations within the body of the luminaire in order to reflect light from the light source in a particular direction.

In luminaires that make use of incandescent or HID lamps, it may be relatively difficult to control the directionality of the lighting since incandescent and HID lamps are omnidirectional light sources. For example, in spite of having a reflector and a lens, a luminaire that has an incandescent or an HID lamp may produce light vectors that exit the luminaire and illuminate regions adjacent to the roadway that need not be illuminated. This may result in light trespass issues, but more fundamentally, in a waste of energy. Thus, from a technical standpoint, LEDs are a viable alternative to incandescent and HID lamps; they provide relatively more directional light output and high energy efficiency.

Recent advances in LED manufacturing technologies and increases in demand for energy-efficient luminaires has contributed in increasing the demand for LED-equipped light fixtures. However, it still remains cost-prohibitive to mass-produce luminaires that make use of LEDs, simply because the assembly of such luminaires may require many more parts when compared to the assembly of their incandescent and HID-based counterparts. Accordingly, there is a need to provide LED-based luminaires that use very few components without compromising optical efficiency. Such LED-based luminaires would be relatively less costly to produce and service and thus would provide an economical alternative to incandescent and HID-based light fixtures.

SUMMARY

In one illustrative embodiment, the present disclosure provides a luminaire optical system that includes a first optical module and a second optical module. The first optical module includes a first reflective surface configured to output light vectors in a first direction. The second optical module includes a second reflective surface configured to reflect light vectors from the second optical module in a second direction. The first reflective surface and the second reflective surfaces are surfaces of one reflector.

In another illustrative embodiment, the present disclosure provides a luminaire comprising a reflector that includes a plurality of sections. The luminaire may also include a support member disposed underneath the reflector. The luminaire may include a lid that encloses the reflector and the support member, the lid being fitted with an edge that mates with a part of the luminaire to hold the support member and the reflector in place. Further, sections of the plurality of sections are co-linearly disposed and the reflector is made of a single component.

In yet another illustrative embodiment, the present disclosure provides a method of assembling a luminaire. The method may include disposing in a body of the luminaire, a reflector made of a single part. The reflector may include at least two sections isolated from one another and disposed in a co-linear manner. The method may further include disposing light sources within the at least two sections. The light sources may be mounted on a printed circuit board (PCB) located underneath the reflector. The method may also include fitting a lid on the luminaire. The lid may be configured to mate with the body of the luminaire.

Additional features, modes of operations, advantages, and other aspects of various embodiments are described below with reference to the accompanying drawings. It is noted that the disclosure is not limited to the specific embodiments described herein. These embodiments are presented for illustrative purposes only. Additional embodiments, or modifications of the embodiments disclosed, will be readily apparent to persons skilled in the relevant art(s) based on the teachings provided.

BRIEF DESCRIPTION OF THE DRAWINGS

Illustrative embodiments may take form in various components and arrangements of components. Illustrative embodiments are shown in the accompanying drawings, throughout which like reference numerals may indicate corresponding or similar parts in the various drawings. The drawings are only for purposes of illustrating the embodiments and are not to be construed as limiting the disclosure. Given the following enabling description of the drawings, the novel aspects of the present disclosure should become evident to a person of ordinary skill in the relevant art(s).

DETAILED DESCRIPTION

While illustrative embodiments are described herein for particular applications, it should be understood that the present disclosure is not limited thereto. Those skilled in the art and with access to the teachings provided herein will recognize additional applications, modifications, and embodiments within the scope thereof and additional fields in which the present disclosure would be of significant utility.

Embodiments of the present disclosure may provide a luminaire that requires fewer components than existing luminaires. Further, the embodiments may provide a means to isolate optical elements that perform separate photometric functions, thereby allowing the luminaire to be scaled down in size, with reduced width, and thus reducing the number of parts required to assemble the fixture. Furthermore, embodiments of the present disclosure confer several advantages such as lower cost, improved photometrics, and novel control features associated with lumen output control. Several of these exemplary embodiments are discussed in detail below.

Figure 1A:
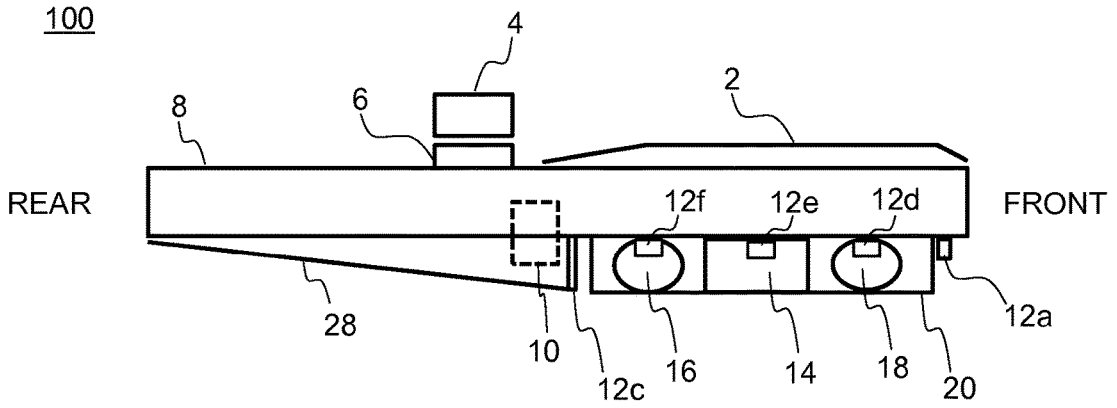
FIG. 1A is a partial sectional side view of a luminaire, according to an exemplary embodiment.

FIG. 1A illustrates a side view of a luminaire 100, according to an exemplary embodiment. Luminaire 100 includes a body 8 that encloses or otherwise supports various optoelectronic components. Furthermore, luminaire 100 may include support members 12*a* and 28, which serve to secure the various structural components of luminaire 100. Body 8 may also include a power supply unit (PSU) 10 for providing and regulating the electrical power used by the various optoelectronic components included within body 8. As will be discussed below with respect to FIGS. 4A-4D, body 8 may have one of several shapes. Furthermore, in some embodiments, sidewalls of body 8 may include transparent windows through which light originating from within body 8 may escape. In other embodiments, body 8 may be opaque, with light exiting luminaire 100 only through a transparent lid, as will be discussed below.

In some embodiments, a fin 2 may be disposed on a dorsal portion of body 8. Fin 2 may enhance heat dissipation properties of luminaire 100, the heat arising from operating the optoelectronic components included in luminaire 100. Fin 2 may include a plurality of grooves or corrugations designed to further enhance heat dissipation from luminaire 100. Furthermore, in some embodiments, fin 2 may be a feature that is machined within the dorsal portion of body 8. In alternate embodiments, fin 2 may be a discrete part that is affixed to the dorsal portion of body 8, using a thermally conductive adhesive, for example. In yet other exemplary embodiments, luminaire 100 may not include a fin at all.

Luminaire 100 may further include a lid 20. Lid 20 may serve to protect the components included in luminaire 100 from the surrounding environment. And it may also serve as a lens. In embodiments with curved lids, lid 20 may be flat. In other embodiments, lid 20 may be curved. In such curved embodiments, the radius of curvature of lid 20 may be selected so as to provide enhanced light distribution. Lid 20 may be made of a transparent material. For example, lid 20 may be made of a clear polymeric material. In some embodiments, the polymeric material may include an acrylic polymer. In other embodiments, lid 20 may be made of glass.

While lid 20 has been described as transparent, i.e. as being optically clear, one of ordinary skill in the art will readily appreciate that lid 20 may be tinted or a filter may be applied thereon. More generally, the transmission properties of lid 20 may be designed to provide a colored light perspective to an observer. By way of example, and not by limitation, lid 20 may be tinted so as to make light exiting luminaire 100 appear yellow, even though the light sources included in luminaire 100 may be configured to emit white light.

In some embodiments, the dorsal portion of body 8 may further include a receptacle 6 configured to receive and hold in place a photo-sensor (PS) element 4. Receptacle 6 may be a socket that interfaces one or more components located within body 8 with PS element 4. PS element 4 may be an optoelectronic circuit configured to convert ambient light energy into an electrical current or a voltage signal. The electrical current or voltage signal may be further processed to generate a control signal indicative of the ambient light intensity, the intensity being indicative of daytime conditions or nighttime conditions.

The generated control signal may be used to turn on (activate) or turn off (deactivate) one or more light sources included in luminaire 100, depending on the ambient light intensity. In some embodiments, PS element 4 may be configured to gradually turn on one or more light sources included in luminaire 100 or gradually turn off the one or more light sources included in luminaire 100. PS element 4 may interface with PSU 10 in order to perform the aforementioned functions.

One of ordinary skill in the art will readily understand that PS element 4 may include any light-responsive sensor capable of transducing light into an electrical current or voltage. For example, PS element 4 may include a light-sensitive sensor that is at least one of a solar cell, a photodiode, a photo-gate sensor, and a photo-resistive material. Furthermore, in some exemplary embodiments, PS element 4 may include a timing circuit configured to turn on one or more light sources or to turn the one or more light sources off based on pre-determined time markers outputted by the timing circuit.

Luminaire 100 may include a first optical module 14, a second optical module 16, and a third optical module 18. Each of the first, second, and third optical modules may include a light source and reflector surfaces. The light sources may be one or more banks of light-emitting diodes (LEDs). First optical module 14, second optical module 16, and third optical module 18 may be co-linearly disposed so as to fit a narrow body 8 like the examples shown in FIGS. 4A-4D.

Figure 1B:
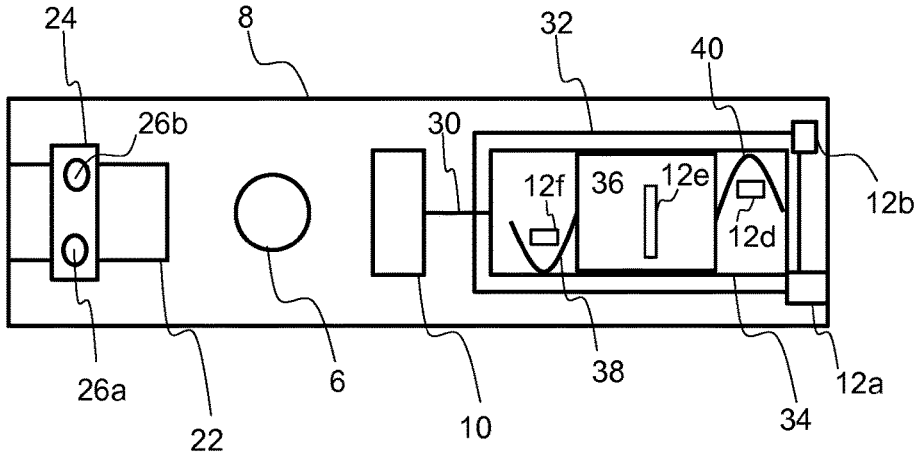
FIG. 1B is a partial bottom view of a luminaire, according to an exemplary embodiment.

FIG. 1B shows a bottom view of luminaire 100, according to an exemplary embodiment. First optical module 14, second optical module 16, and third optical module 18 together form a single luminaire optical system that includes light sources and reflective surfaces. Furthermore, in some embodiments, first optical module 14, second optical module 16, and third optical module 18 may correspond to distinct sections of the optical system. For example, first optical module 14 may correspond to a first section 36, second optical module 16 may correspond to a second section 34, and third optical module 18 may correspond to a third section 40. Further, first optical module 14 may be placed in the center of the luminaire optical system in isolation from first optical module 14 and third optical module 18. Furthermore, second optical module 16 may be placed behind and adjacent to module 14 in second section 38 and third optical module 18 may be placed forward and adjacent to first optical module 14.

First optical module 14 may include reflective surfaces angled in such a way to direct light vectors in a first direction. (A direction may be thought of as a vector whose orientation describes the general direction of propagation of a ray or a beam of light.) Similarly, second optical module 16 may include reflective surfaces positioned to direct light vectors in a second direction. And third optical module 18 may include reflective surfaces positioned to direct light in a third direction. In some embodiments, the second direction may form angle with the first direction that is between 0 degrees and 90 degrees. Similarly, the third direction may form an angle with the first direction that is between 0 degrees and 90 degrees. Furthermore, in some embodiments, the third direction may be opposite to the second direction, with a line of symmetry being the first direction.

In one exemplary embodiment, the first direction may be a nadir direction, the nadir direction being the direction directly below luminaire 100, when such a luminaire is mounted on a street post. In this embodiment, the second direction may be to the left of luminaire 100, and the third direction may be to the right of luminaire 100.

Luminaire 100 may include a printed circuit board (PCB) 32 that supports reflector 34, as well as first optical module 14, second optical module 16, and third optical module 18, which are located in the respective sections of reflector 34 mentioned above. PCB 32 may include electrical traces (not shown) which are coupled to PSU 10 via link 30. In some embodiments, link 30 may be a connection means that electrically interfaces PSU 10 with PCB 32. For example, in some embodiments, link 30 may be an edge connector. In other embodiments, link 30 may simply be electrical wires that connect PSU 10 to PCB 32. In other embodiments, link 30 may include amp push-on terminals.

FIG. 1B further shows additional structural features that may be included in luminaire 100, according to exemplary embodiments. For example, luminaire 100 may include support member 12*b* which serves, along with support members 12*b* and 12*c* (see FIG. 1A), to hold lid 20 secured to an inner surface of body 8. Furthermore, luminaire 100 may include a slip-fitter 22 which serves to mount luminaire 100 on a horizontal arm or pipe. In one exemplary embodiment, slip-fitter 22 may consist of a cradle formed in body 8, and a clamp 24 would secure a pipe/arm using the force supplied by screws/bolts 26*a* and 26*b*.

Figure 1C:
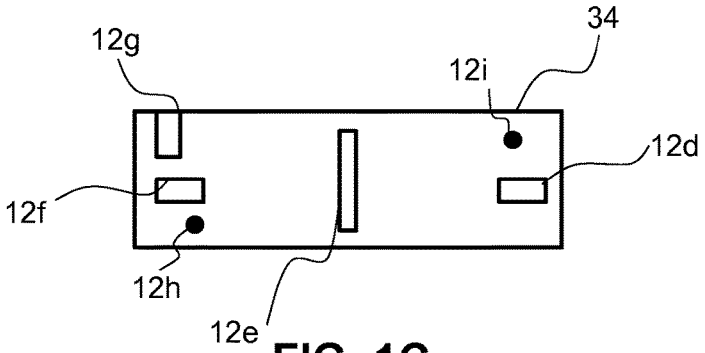
FIG. 1C is illustrates a printed circuit board (PCB) included in a luminaire, according to an exemplary embodiment.

Turning now to FIG. 1C, additional structural features of luminaire 100 are discussed. FIG. 1C is a close-up view of PCB 32, according to an embodiment. PCB 32 may include features 12*h*-12*i* that may be used to provide additional alignment for reflector 34 and lid 20. PCB 32 may be narrowly shaped so as to fit within body 8. Feature 12*g* may be a connector that is part of link 30. During assembly, the location of features 12*d*-12*g* on PCB 32 may be used to register the positioning of reflector 34.

Furthermore, in some embodiments, feature 12*g* may be implemented using a wire push-in connector. In other embodiments, features 12*e*, 12*d*, and 12*f* may be pads onto which light sources of the first optical module 14, that of the second optical module 16, and that of the third optical module 18 are mounted. Traces of PCB 32 (not shown) may connect features 12*e*, 12*d*, and 12*f* to feature 12*d*, thus providing electrical connectivity between PSU 10 and each of the light sources included in the optical modules and for the purpose of powering and regulating the light sources.

Figure 1D:
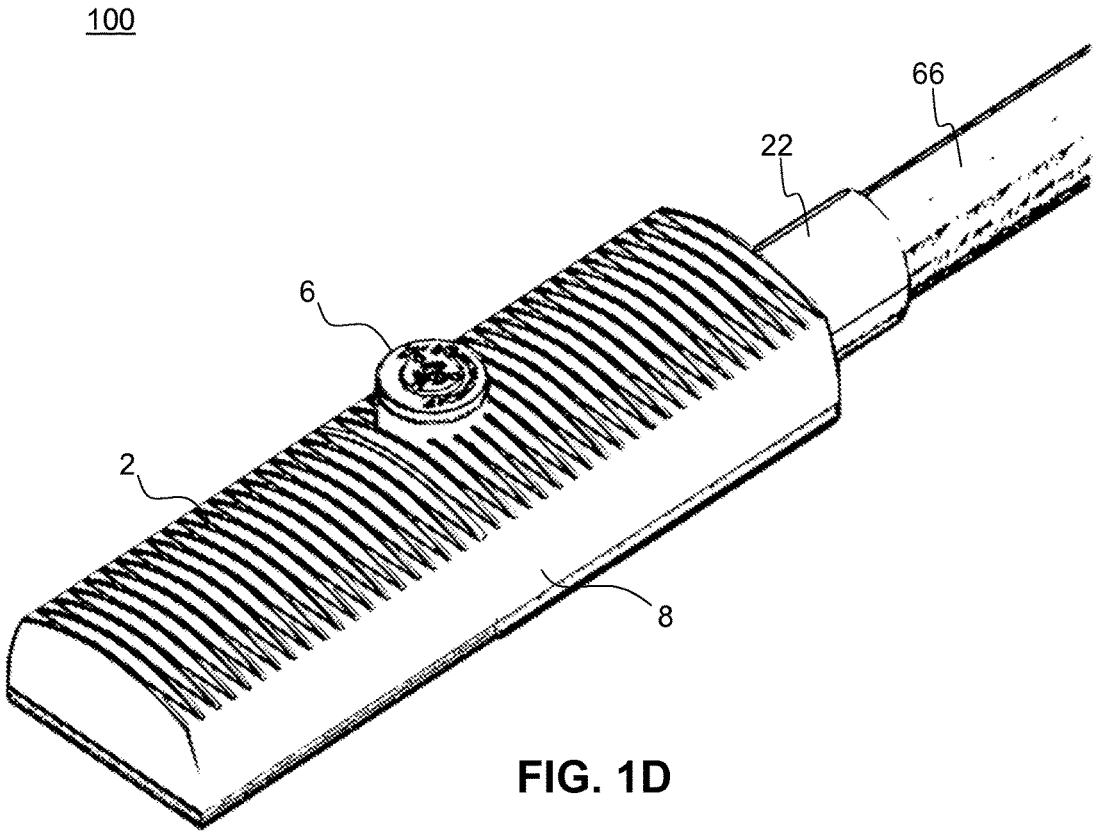
FIG. 1D shows a perspective view of a luminaire, according to an exemplary embodiment.
Figure 1E:
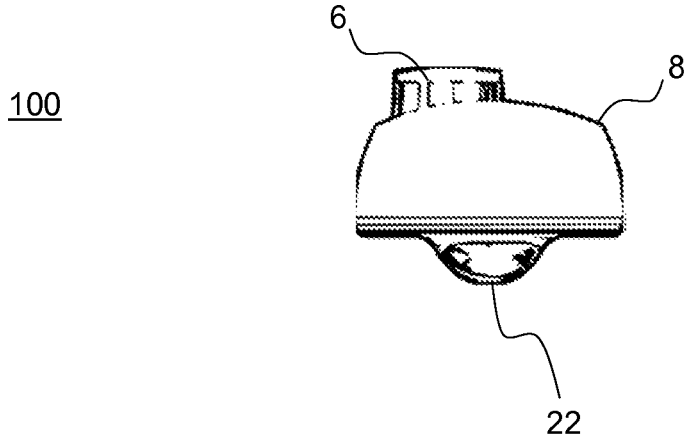
FIGS. 1E-1F are front view cross-sections of a luminaire, according to exemplary embodiments.
Figure 1F:
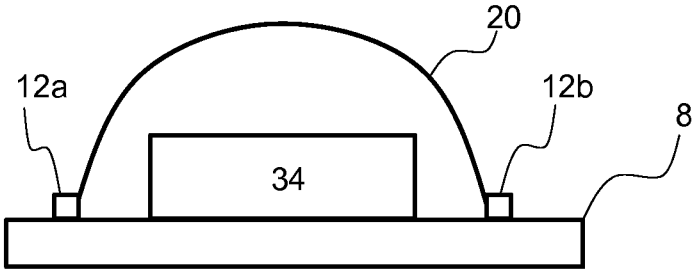

FIG. 1D provides a perspective view of luminaire 100, according to an exemplary embodiment. As can be seen from FIG. 1D, luminaire 100 may be mounted on a post 66 using slip-fitter 22. Luminaire 100 may have a curved lid 20, as shown in exemplary cross-sectional views of FIGS. 1E and 1F. As mentioned above, the radius of curvature of lid 20 may be selected so as to provide enhanced light distribution. Specifically, the radius of curvature of lid 20 may be selected so that light vectors exiting luminaire 100 are orthogonal to the surface of lid 20, further reducing light transmission losses.

The embodiments described above and those that follow offer the advantages of significantly reducing the cost of manufacturing a luminaire. For example, in FIGS. 1E and 1F, luminaire 100 may require at most 3 screws to secure PBC 32 to body 8. Since reflector 34 is only a single part (albeit having three optically isolated sections), in some embodiments, it may be secured with only one screw. Moreover, lid 20 may be used to passively secure reflector 34 and PCB 32 using a gasket (not shown) between an edge of lid 20 and a mating part inside body 8. As such, lid 20 and reflector 34 may be held in place (i.e. secured to body 8) using only one screw. In some embodiments, lid 20 may be made to capture reflector 34, and as such, no screw is required to secure reflector 34. Thus, the embodiments disclosed herein all provide an ease of assembly that facilitates and reduces the costs of both manufacturing and servicing the luminaire.

Figure 2A:
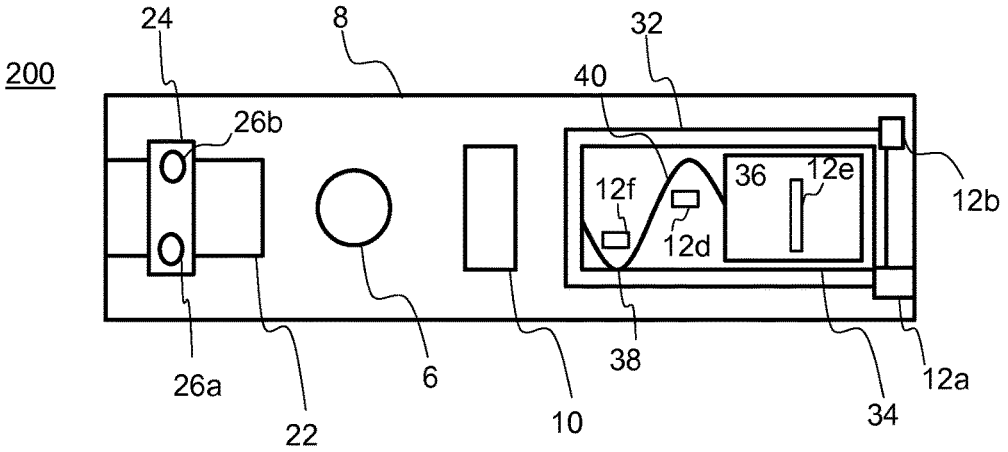
FIGS. 2A-2C are bottom views of luminaires having several configurations, according to exemplary embodiments.
Figure 2B:
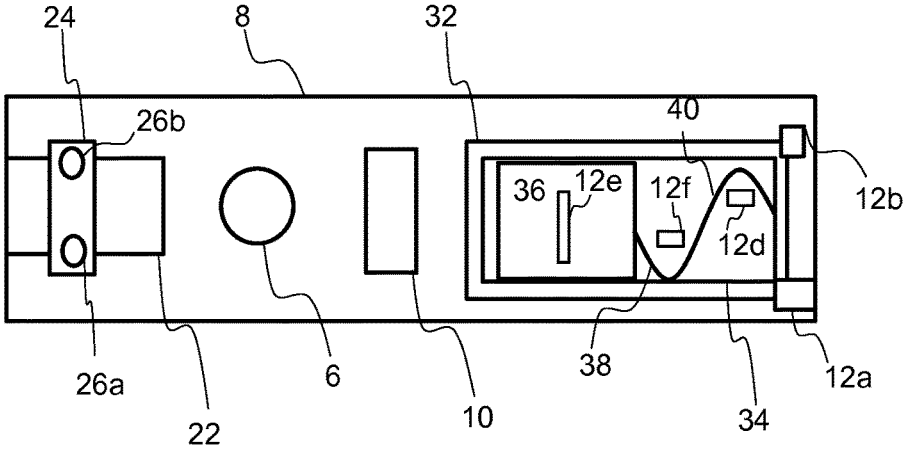
Figure 2C:
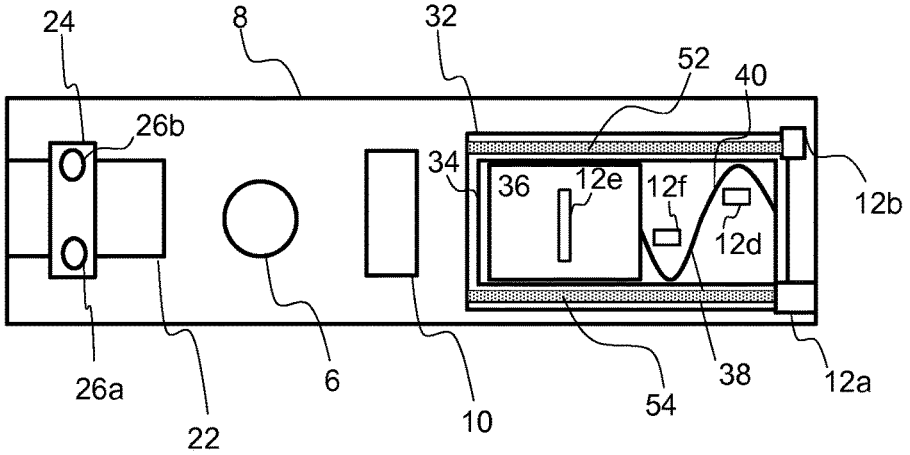

Turning now to FIGS. 2A-2C, several configurations of a luminaire 200 are discussed according to exemplary embodiments. In the exemplary embodiments depicted in FIGS. 1A-1C, second section 38 and third section 40 were disposed on the left and right side of first section 36, respectively.

As shown in FIG. 2A, another configuration is possible, according to an embodiment. Namely, second section 38 and third section 40 may be contiguous, thus forming a continuously curved portion in reflector 34. In some embodiments, second section 38 and third section 40 may form a shape that is substantially equivalent to the shape of the letter "S," or to that of a reversed "S." In other embodiments, the continuously curved portion formed by second section 38 and third section 40 may be on the left of first section 36, as shown in FIG. 2A, or it may be on the right of first section 36, as shown in FIG. 2B.

Furthermore, in some embodiments as shown in FIG. 2C, planar reflective surface 52 and 54 may be disposed on either side of reflector 34 in order to provide additional light control. In such embodiments, lid 20 may be flat, as opposed to being curved, as discussed above with respect to FIGS. 1E and 1F.

Figure 3A:
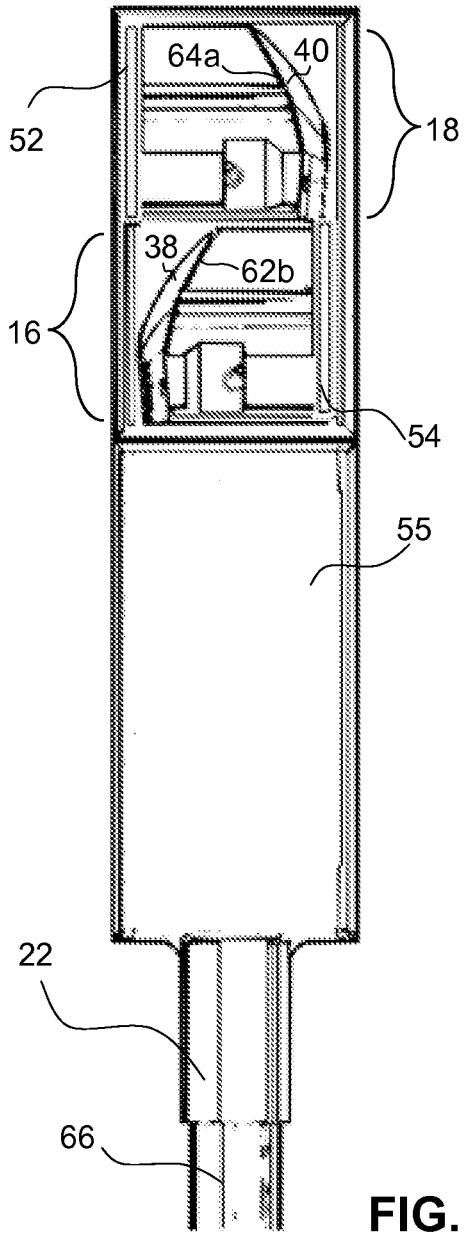
FIGS. 3A-3B are bottom views of a luminaire, according to exemplary embodiments.

FIG. 3A is a bottom view of a luminaire 300 according to an exemplary embodiment where lid 20 is flat. However, in this exemplary embodiment, first optical module 14 is split and shared among second optical module 16 and third optical module 18. This exemplary reflector (shown in FIG. 6) may be more difficult to mold, but it may further reduce fixture size. Luminaire 300 may include a door 55 which may be hinged or screwed onto body 8 to provide access to various components included within body 8. Such components may be, for example, PSU 10 and other electrical modules that may be used to control the optical modules disposed within body 8. In some embodiments, door 55 may be made of plastic cast metal or sheet metal, and it may be mounted tool-less-ly to body 8.

Furthermore, in the exemplary embodiment depicted in FIG. 3A, a planar reflective surface (or mirror) 52 is disposed adjacent to third optical module 18 and opposite to a concave surface 64*a* of third section 40. In such an embodiment, body 8 does not include transparent windows on its sidewalls. As such, light originating from third optical module 18 and that is directed to the sidewall of body 8 may be lost in the absence of mirror 52. As such, mirror 52 serves to reflect stray light originating from third optical module 18 to concave surface 64*a*, which is a surface that is properly angled to let the light exit the fixture in the third direction (as discussed above). The third direction may be a direction to the left of luminaire 300. Similarly, a mirror 54 serves to reflect stray light originating from second optical module 16 to concave surface 62*a*, which is a surface that is properly angled to let the light exit the fixture in the second direction, and the second direction may be to the right of luminaire 300.

Figure 3B:
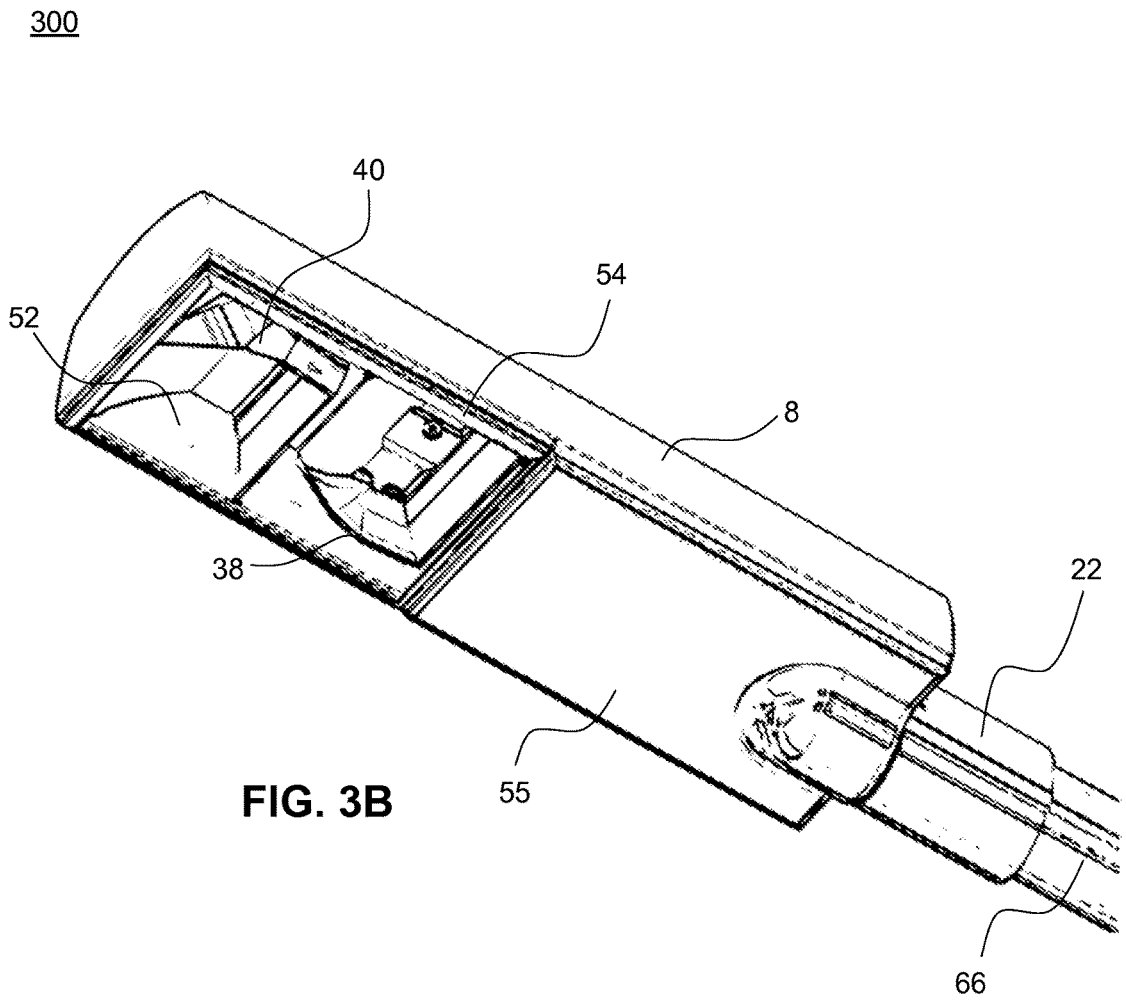
Figure 4A:
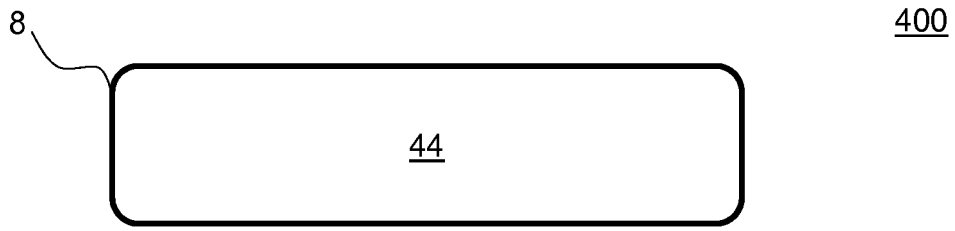
FIGS. 4A-4D depict several body types that may be used in luminaires, according to exemplary embodiments.
Figure 4B:
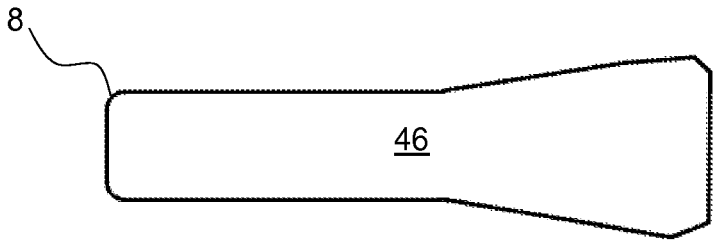
Figure 4C:
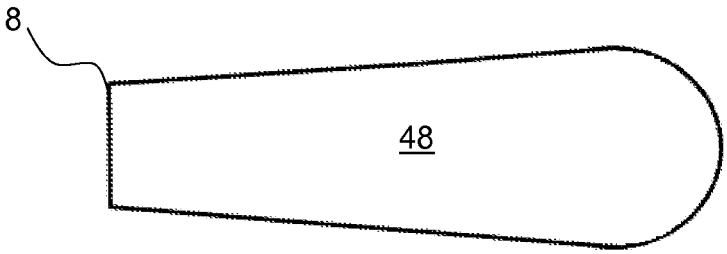
Figure 4D:
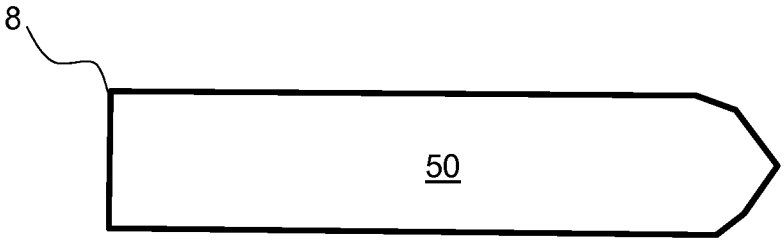

FIG. 3B is a partial bottom view of luminaire 300 in an embodiment that is similar to the one discussed above with respect to FIG. 3A. In FIG. 3B, however, mirrors 52 and 54 may be part of second section 38 and third section 40, respectively.

FIGS. 4A-4D are illustrations of several body types that may be used for a luminaire 400, according exemplary embodiments. In an embodiment, body 8 may be formed or molded to have the shape of a rounded rectangle 44. In an alternate embodiment, body 8 may be formed or molded to the shape of a horn 46. In another embodiment, body 8 may be of a "skinny cobra" shape 48. In yet another embodiment, body 8 may have the shape of a bullet 50. While only these four shapes are shown, one of skill in the art will readily appreciate that other narrowly shaped frames may be used for body 8 without departing from the scope of the disclosure.

Figure 5:
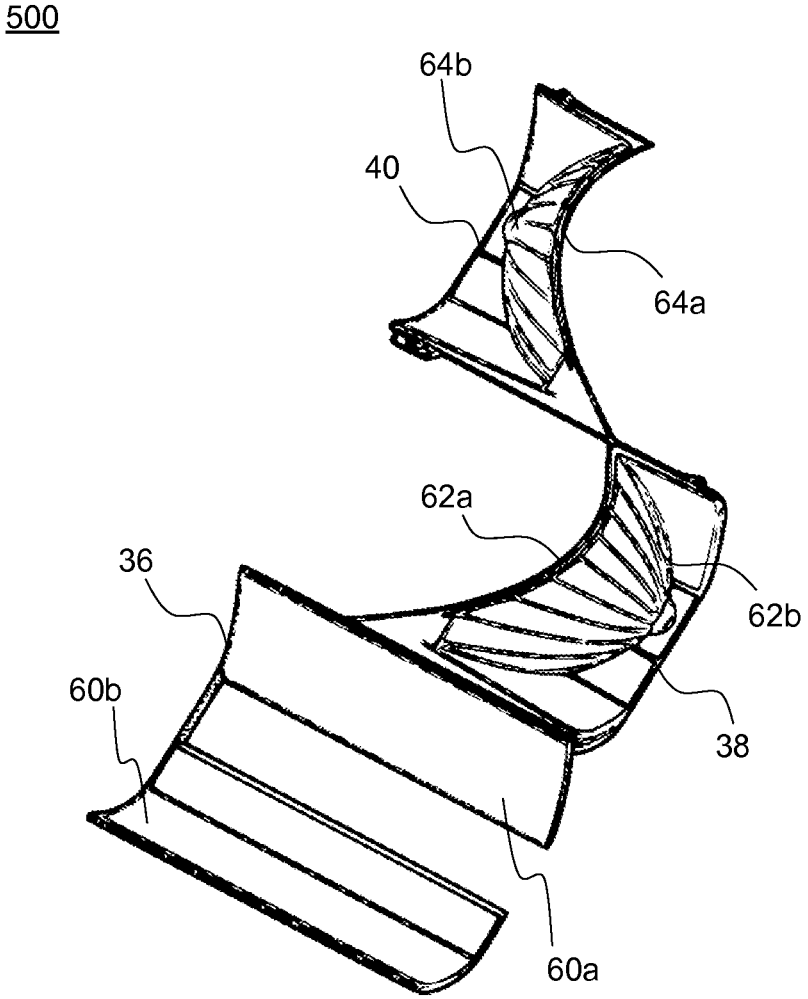
FIG. 5 shows a perspective view of a reflector, according to an exemplary embodiment.

FIG. 5 shows a three-dimensional perspective of a reflector 500, according to an exemplary embodiment. Reflector 500 may have a first section 36, a second section 38, and a third section 40. All three sections form a single part, namely reflector 500. In other words, reflector 500 is a single structure that may be inserted or mounted within the body of a luminaire, such as the ones previously described in this disclosure. Reflector 500 may be metallized in its entirety, or at specific locations, so as to provide highly reflective surfaces.

For example, first section 36 may include reflective surfaces 60*a* and 60*b*. Reflective surfaces 60*a* and 60*b* may be angled in such a way to reflect light originating from a light source (not shown) located within first section 36 in a first direction. The first direction may be, for example, the nadir direction. Similarly, second section 38 may include a reflective surface 62*a* configured to reflect light from a light source (not shown) located within second section 38 in a second direction. Furthermore, third section 40 may include a reflective surface 64*a* configured to reflect light from a light source (not shown) located within third section 40 in a third direction.

As in the previously described embodiments, the third direction and the second direction may be opposite to one another, around a symmetry line given by the nadir direction (i.e. the first direction). For example, the second direction may be to the left of a luminaire that includes reflector 500, and the third direction may be to the right of the luminaire.

In some embodiments, reflector 500 may include a curved portion formed by second section 38 and third section 40. In other embodiments, the curved portion may have a shape equivalent or substantially equivalent to the shape of the letter "S." In such embodiments, reflective surface 62*a* is a concave inner surface opposite a convex outer surface 62*b*. Similarly, reflective surface 64*a* is a concave inner surface opposite a convex outer surface 64*b*.

Reflector 500, as configured, offer several advantages. It may be manufactured using a single step (or pull), and its surfaces may be coated with reflective material (e.g. aluminum), in a single step. Furthermore, reflector 500 may easily be scaled down while keeping the position of the centers of the optical modules unchanged with respect to body 8. As such, luminaires designed according to the teachings disclosed herein may assume a wide variety of narrowly shaped bodies of which examples are provided in FIGS. 4A-4D.

Furthermore, reflector 500 and the other features of the present disclosure confer several advantages such as providing corner optics (i.e. second optical module 16 and third optical module 18) and nadir optics (first optical module 14) that may be ratioed in lumen output separately. That is, the light intensity from each module may be controlled precisely; namely, the light intensity from one module may be set to be equal to a pre-determined fraction of the light intensity of another module since each module is optically isolated from one another by the use of a reflector like reflector 500.

In some embodiments, "ratio-ing" the lumen output may be achieved in-factory by providing luminaires that include fixed LED count ratios. In alternate embodiments, ratio-ing may be implemented dynamically by turning on/or off banks of LEDs in first optical module 14, second optical module 16, and third optical module 18 so as to yield a pre-determined LED count ratio. As such, the disclosed embodiments provide better light control capability than what can be achieved with luminaires of the related art.

Figure 6:
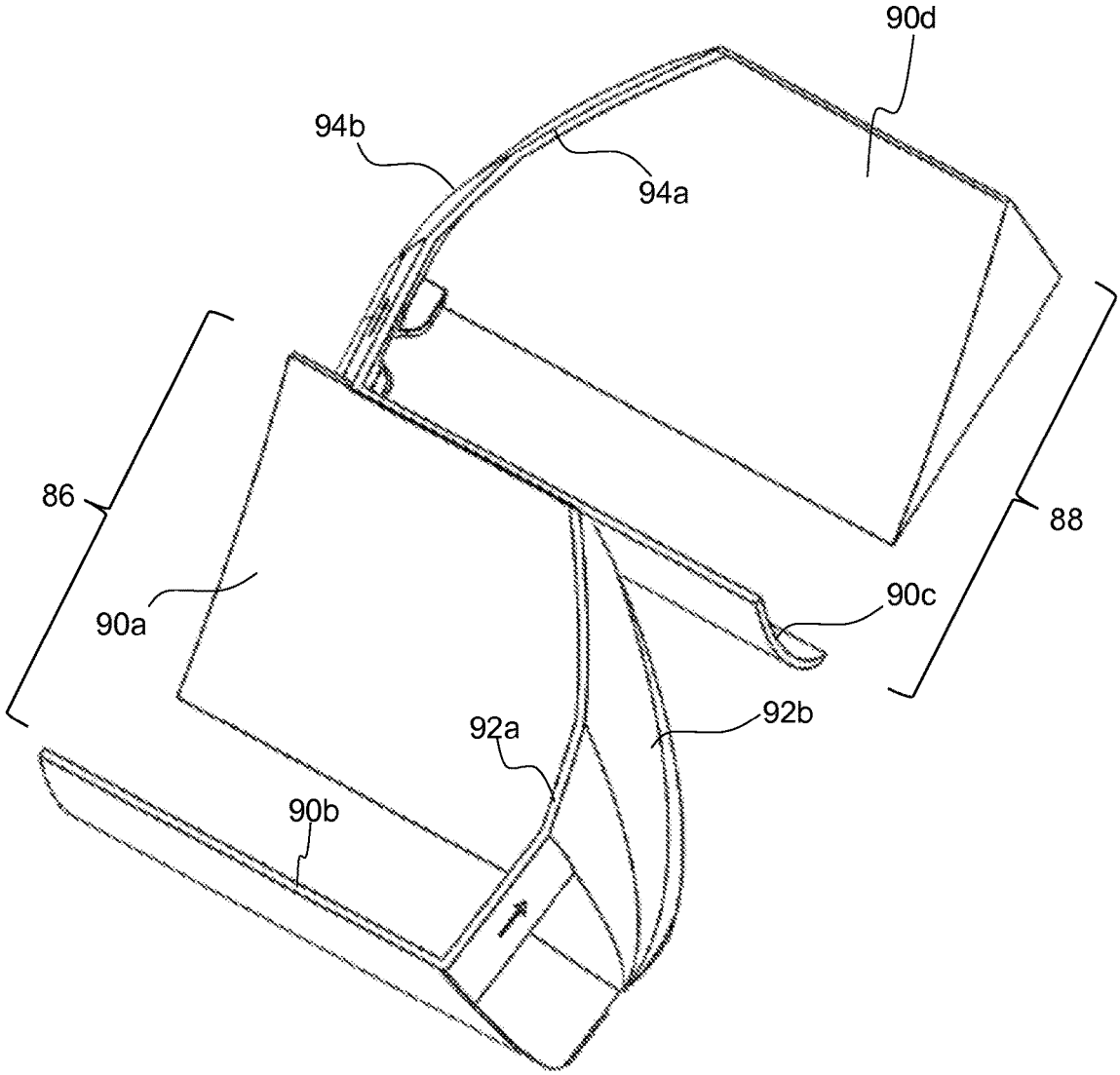
FIG. 6 shows a perspective view of a reflector, according to an exemplary embodiment.

FIG. 6 shows a three-dimensional perspective of a reflector 600, according to an exemplary embodiment. Reflector 600 may have a first section 86 and a second section 88. Unlike the exemplary embodiments described previously, reflector 600 does not include a third section. Nevertheless, reflector 600 accomplishes the same functions previously described with respect to reflector 500. Namely, reflector 600, as configured, directs light in a first direction, a second direction, and a third direction, wherein the second and third directions are opposite and on either side of the first direction. For example, when mounted in a luminaire, reflector 600 may provide a light in a first direction that is the nadir direction, the second and third directions being opposite to each other and about the nadir direction (e.g. to the left and right of the luminaire, wherein the nadir direction is direction directly beneath the luminaire).

In reflector 600, both first section 86 and second section 88 form a single part. In other words, reflector 600 is a single structure that may be inserted or mounted within the body of a luminaire, such as the ones previously described in this disclosure (FIGS. 4A-4D). Reflector 600 may be metallized in its entirety, or at specific locations, so as to provide highly reflective surfaces. For example, first section 86 may include reflective surfaces 90*a*, 90*b*, and a concave surface 92*a* whose outward surface is a curved surface 92*b*. Reflective surfaces 90*a* and 90*b* may be angled in such a way to reflect light originating from a light source (not shown) located within first section 86 in a first direction. The first direction may be, for example, the nadir direction. Reflective surface 92*a* may reflect light from a light source located within first section 86 in a second direction.

Furthermore, second section 88 may include reflective surfaces 90*c*, 90*d*, and a concave surface 94*a* whose outward surface is a curved surface 94*b*. Reflective surfaces 90*c* and 90*d* may be angled in such a way to reflect light originating from a light source (not shown) located within second section 88 in the same first direction as the first direction in first section 86. Reflective surface 92*a* may reflect light from the light source located within second section 88 in a third direction. As previously mentioned, the second and third directions may be opposite to one another about the first direction.

Reflector 600, as configured, offer several advantages. It may allow for a smaller PCBA than the one used with reflector 500, and its surfaces may be coated with reflective material (e.g. aluminum), in a single step. Furthermore, reflector 600 may easily be scaled down while keeping the position of the centers of the optical modules unchanged with respect to body 8. As such, luminaires designed according to the teachings disclosed herein may assume a wide variety of narrowly shaped bodies of which examples are provided in FIGS. 4A-4D. Further, reflector 600 may be used to create, without compromising functionality, a smaller luminaire than one that would be achievable with reflector 500.

Reflector 600 confers several advantages such as providing corner optics and nadir optics that may be ratioed in lumen output separately. That is, the light intensity from each optical module located in first section 86 and second section 88 may be controlled precisely; namely, the light intensity from one module may be set to be equal to a pre-determined fraction of the light intensity of another module since each module is optically isolated from one another by the use of a reflector like reflector 600.

In some embodiments, "ratio-ing" the lumen output may be achieved in-factory by providing luminaires that include fixed LED count ratios. In alternate embodiments, "ratio-ing" may be implemented dynamically by turning on/or off banks of LEDs in first optical module 14, second optical module 16, and third optical module 18 so as to yield a pre-determined LED count ratio. As such, the disclosed embodiments provide better light control capability than what can be achieved with luminaires of the related art. Separate "ratio-ing" is possible because each optical module is isolated from one another by virtue of the optical isolation provided by first section 86 and second section 88.

Furthermore, one of skill in the relevant art(s) will readily appreciate that in some embodiments, the second and third directions may be symmetric about the nadir direction (i.e. the first direction), provided that the reflective surfaces in first section 86 are angled the same way as their corresponding reflective surfaces in second section 88. In other embodiments, however, and by design, symmetry may not be maintained. Specifically, other embodiments may include reflective surfaces in one section that are angled differently than the corresponding reflective surface in another section. It is noted that this notion of providing a reflector having non-symmetrical light output about the nadir also extends to the previously described embodiments. For example, in the case of reflector 500, this may simply be achieved by having different angles for reflective surface 62*a* and reflective surface 64*a*.

Figure 7:
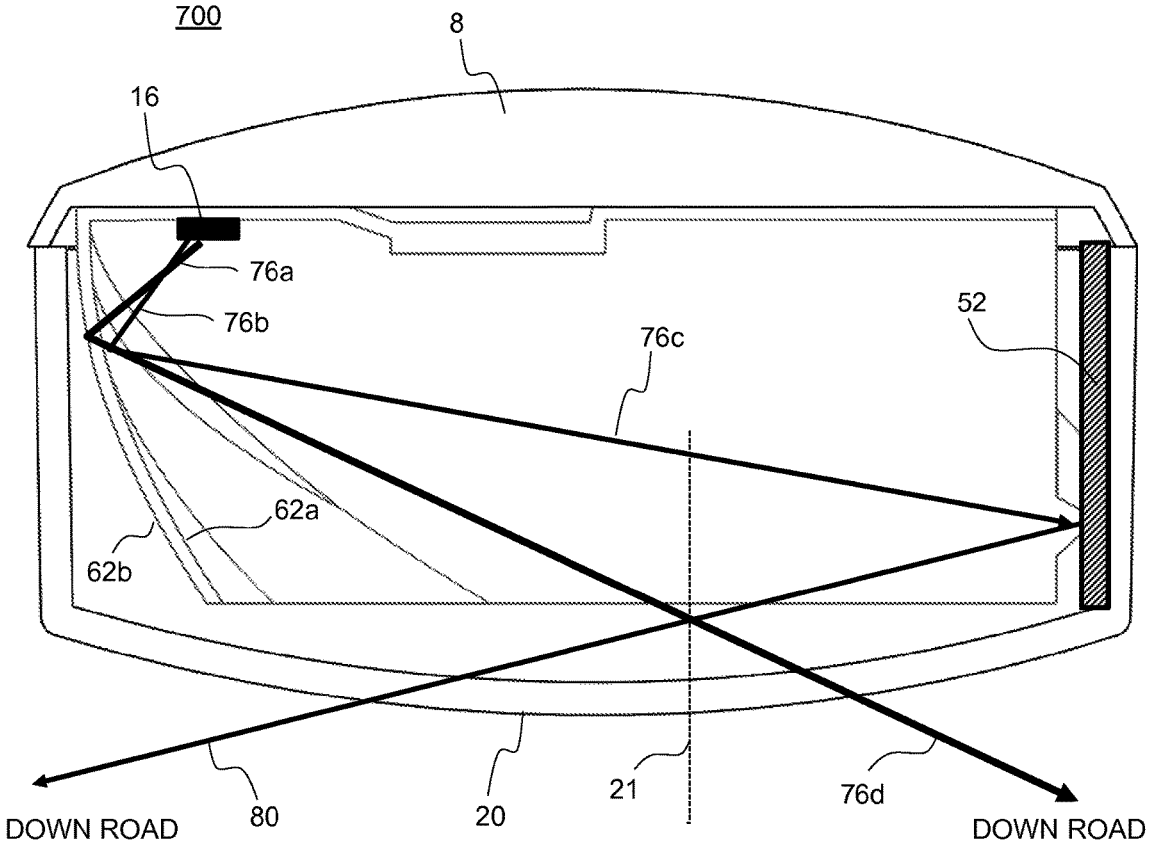
FIGS. 7-8 show cross-sectional views of a luminaire, according to exemplary embodiments.
Figure 8:
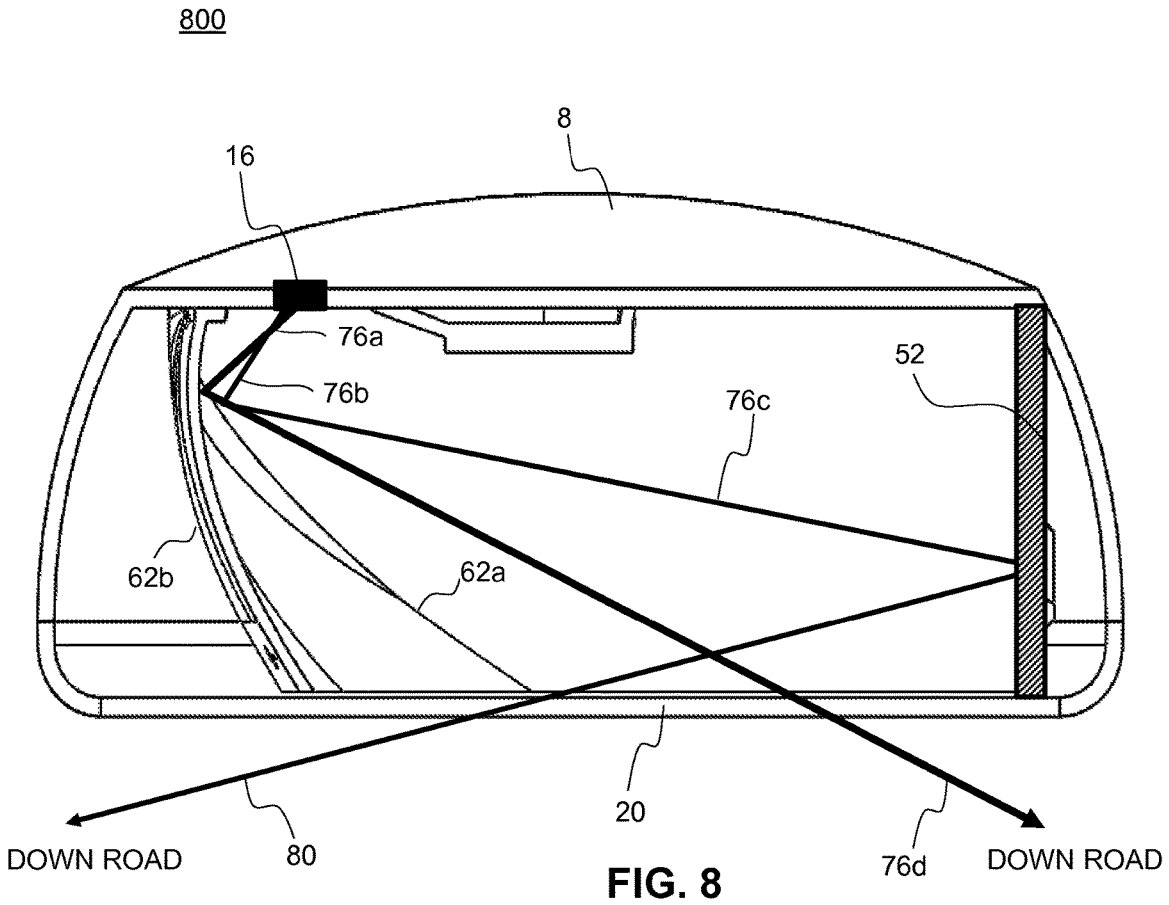

FIGS. 7 and 8 show cross-sectional views 700 and 800 of a luminaire, according to exemplary embodiments. Specifically, FIG. 7 illustrates a cross-sectional view of second section 38, as described with respect to reflector 500 above. As previously mentioned, second section 38 may include a second optical module 16, which may include one or more LEDs. An LED in second optical module 16 may be configured to output light in a pre-determined angular section or emission cone. As such, light escaping the one or more LEDs may hit reflective surface 62*a* at a variety of angles defined by the emission cone. For simplicity only two rays of light from second optical module 16 are shown, namely ray 76*a* and ray 76*b*. Upon hitting reflective surface 62*a*, rays 76*a* and 76*b* are reflected to become rays 76*c* and 76*d*, respectively.

In one embodiment where reflective surface 52 is not present and lid 20 is transparent all around, rays 76*c* and 76*d* may escape the luminaire generally to the right of FIG. 7, as indicated by the directionality of the arrows representing rays 76*c* and 76*d*. This direction may be the second direction mentioned previously with respect to reflector 500. In other embodiments, however, lid 20 may not be transparent all around, and only the bottom part of lid 20 may be transparent. Stated otherwise, lid 20 may have opaque sidewalls, with only a transparent bottom section to allow light to escape the luminaire.

In such embodiments, a reflective surface 52 may be placed opposite reflective surface 62*a* as shown in FIG. 7. In this configuration, ray 76*d* still escapes the luminaire as described previously and continues in the second direction. However, ray 76*c* cannot escape the luminaire in the second direction since the sidewall of lid 20 is opaque. In order to not lose this light output, mirror 52 serves to reflect ray 76*c* in a direction 80, which is generally to the left of FIG. 7; direction 80 may be thought of as the third direction mentioned above with respect to reflector 500.

In some embodiments, reflective surface 52 and reflective surface 62*a* may be angled in such a way to provide symmetry for rays 76*d* and 80 about a normal vector 21. In other embodiments, symmetry may not be required and the mirror 52 and reflective surface 62*a* may be disposed accordingly. Furthermore, in yet other embodiments, a first section 86 (as shown in FIG. 6) may be used instead of a second section 38. In such an embodiment, reflective surfaces 90*a*, 90*b* would provide light in a first direction, i.e. in the nadir direction downward along vector 21. Mirror 52 and reflective surface 92*a* would provide light in the third direction and second direction and about the nadir direction, respectively.

As shown in FIG. 7, the bottom portion of lid 20 may be curved. A pre-determined curvature may be selected so as to create a desired lensing effect. In some embodiments, that curvature may be selected so that light escaping the luminaire is normal to lid 20 upon escape. In yet other embodiments, all of lid 20 may be curved. In other embodiments, such as shown in FIG. 8, the bottom portion of lid 20 may be flat. In other embodiments (such as in FIG. 8), lid 20 may be flat at the bottom and curved on the sidewall. The sidewalls may or may not be transparent. In the case where the sidewalls are not transparent, mirror 52 may be used as discussed above. Generally, in the embodiment shown in FIG. 8, all the design options discussed above with respect to FIG. 7 also apply.

Figure 9:
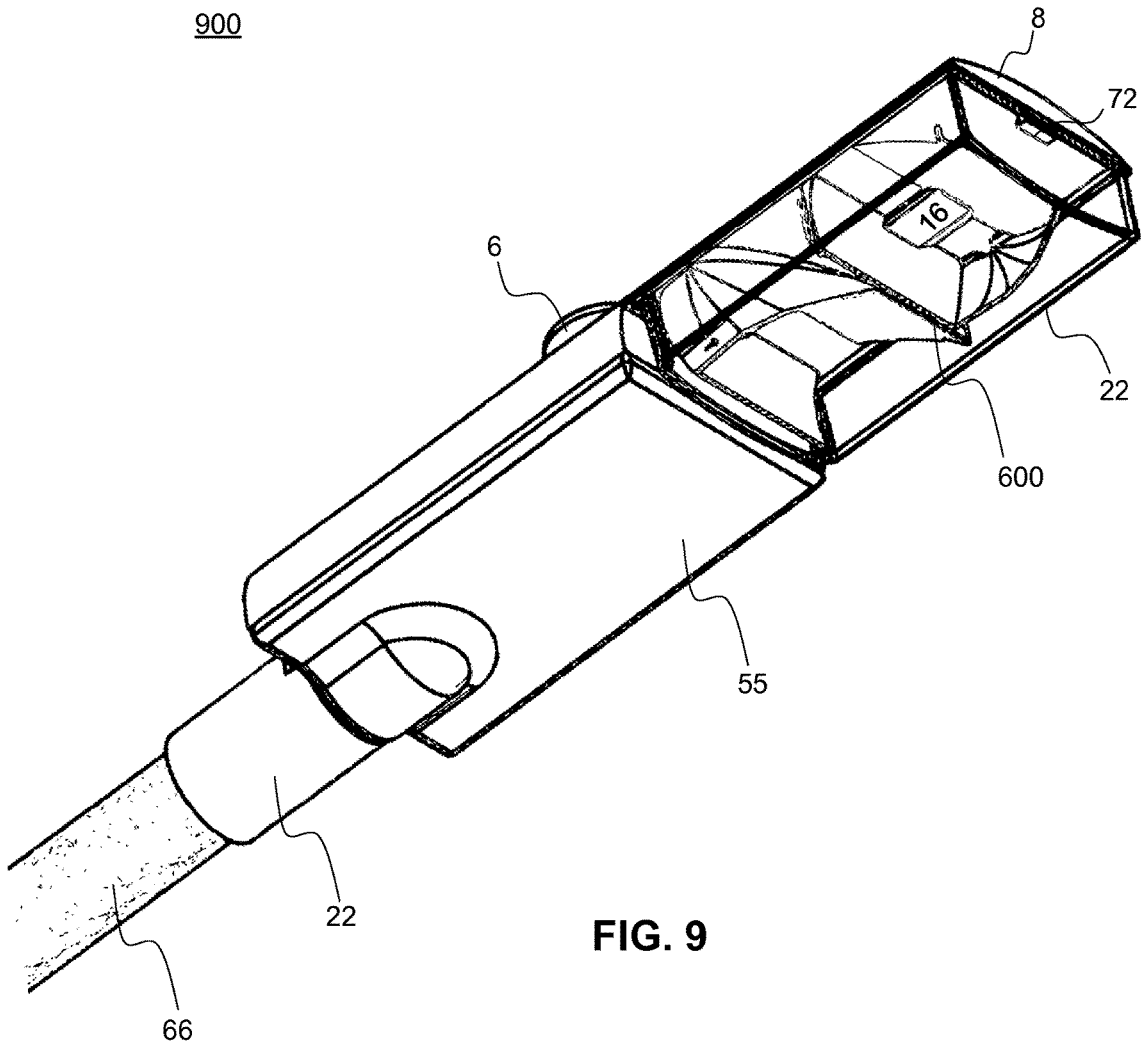
FIG. 9 illustrates a luminaire, according to an exemplary embodiment.

FIG. 9 illustrates a luminaire 900, according to an exemplary embodiment. Luminaire 900 is similar to luminaire 300. However, luminaire 900 includes a lid 20 that is transparent all around. Furthermore, luminaire 900 is fitted with reflector 600 that only includes two sections (namely first section 86 and second section 88). As previously mentioned, first section 86 is configured so that light may escape luminaire 900 in a first direction and in the nadir direction, such as a direction along vector 21 shown in FIG. 7. Second section 88 is configured so that light may escape luminaire 900 in a second direction opposite to the first direction and in the nadir direction. Lid 20 may be fitted to body 8 using a fastener 74 and a tuck 72.

As configured, luminaire 900 preserves the same functionality of luminaire 300, which had three sections (of which one was not shown), while making use of only two sections. In either case however, the same manufacturing advantages are preserved since either of reflector 500 or reflector 600 may be manufactured to be a single component.

In industrial applications, the embodiments of the disclosed luminaire may be applicable to situations in which stringent light control is required and only a minimal number of components is to be used in assembly. Further, while the disclosure has thus far focused on roadway lighting, one of skill in the art will readily appreciate that luminaires according to the present disclosure may be used in applications other than roadway lighting. Such applications may be, for example, indoor commercial lighting, and residential lighting, to name a few. Furthermore, embodiments of the present disclosure may be used to implement class 1 (high wattage) and class 2 (low wattage) luminaires.

As stated above, the disclosed embodiments provide ease of assembly and ease of servicing a luminaire. In some embodiments, the use of a narrowly shaped reflector such as reflector 500 or reflector 600 may be an important factor in allowing the aforementioned ease of assembly and ease of servicing of the luminaire. Modeling revealed that the use of a reflector such as reflector 500 or reflector 600 does not compromise optical efficiency of the luminaire. For example, when compared with a luminaire that uses a multi-piece reflector with disjoint and non-isolated sections, and with a symmetry mirror disposed in the middle of the luminaire's body, embodiments of the present disclosure showed a negligible difference in optical efficiency (about less than 2%). As such, luminaires designed and fabricated according the disclosed exemplary embodiments provide all the aforementioned benefits without trading-off optical efficiency.

Figure 10:
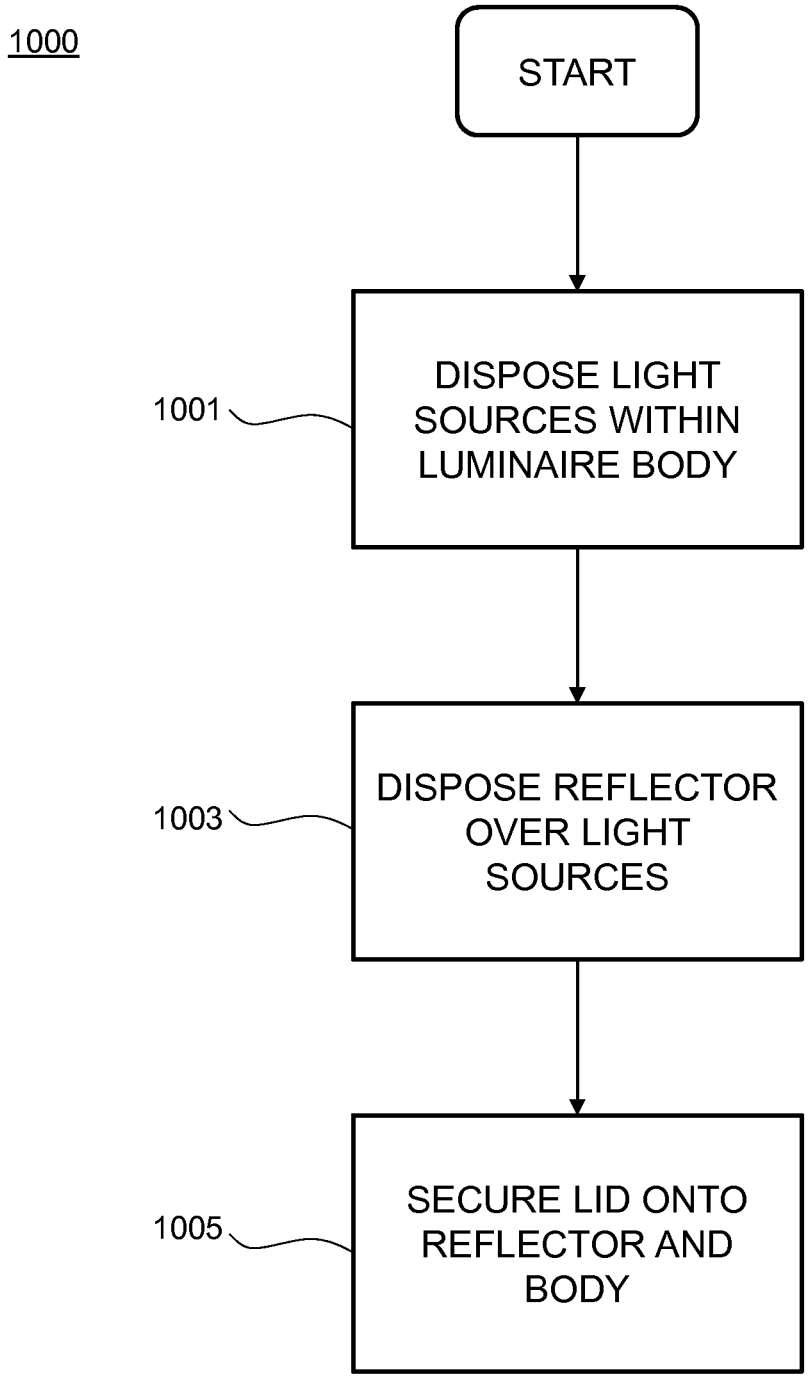
FIG. 10 illustrates a flow chart of a method of assembling a luminaire, according to an exemplary embodiment.

FIG. 10 illustrates a flow chart for a method 1000 of assembling a luminaire, according to an exemplary embodiment. The method 1000 may include disposing one or more light sources (step 1001) in a body of the luminaire. The light sources may be mounted on a PCB, such as in the embodiments described throughout this disclosure. In step 1003, method 1000 may include disposing a reflector made of a single part, the reflector including at least two sections optically isolated from one another and disposed in a collinear manner. At this stage, the printed circuit board is located underneath the reflector. The method 1000 may also include securing a lid on the luminaire. The lid may be configured to mate with the body of the luminaire using a gasket (step 1005).

In one embodiment, the light sources may be LEDs. Method 1000 may further include ratio-ing the lumen output from the light sources (step not shown). In some embodiments, ratio-ing the lumen output may be achieved using a pre-determined number of LEDs in each of the at least two sections. In other embodiments, ratio-ing the lumen output may be achieved dynamically, using driving circuitry located within the luminaire to selectively turn on (or turn off) one or more LEDs in each of the at least two sections.

Those skilled in the relevant art(s) will appreciate that various adaptations and modifications of the embodiments described above can be configured without departing from the scope and spirit of the disclosure. Therefore, it is to be understood that, within the scope of the appended claims, the disclosure may be practiced other than as specifically described herein.

What is claimed is:

1. A luminaire optical system, comprising:

a first optical module comprising a first reflective surface configured to output light vectors from the first optical module in a first direction; and a second optical module comprising a second reflective surface configured to reflect light vectors from the second optical module in a second direction, wherein a first planar reflective surface is disposed opposite to the second reflective surface, wherein the first reflective surface and the second reflective surface are concave surfaces of one reflector, wherein the one reflector comprises a first section corresponding to the first optical module and a second section corresponding to the second optical module, the first section and the second section forming a continuously curved portion;

the luminaire optical system further comprising a third optical module, the third optical module comprising a third reflective surface configured to reflect light vectors from the third optical module in a third direction, wherein a second planar reflective surface is disposed opposite to the third reflective surface.

2. The luminaire optical system of claim 1, wherein at least one of the first optical module and the second optical module is further configured to reflect light in a third direction, and wherein the third direction forms an angle that is between 0 degrees and 90 degrees relative to the first direction, and the third direction is opposite to the second direction.

3. The luminaire optical system according to claim 1, wherein the second direction forms an angle that is between 0 degrees and 90 degrees relative to the first direction.

4. The luminaire optical system according to claim 1, wherein the third direction forms an angle that is between 0 degrees and 90 degrees relative to the first direction, and the third direction is opposite to the second direction.

5. The luminaire optical system according to claim 1, wherein the third reflective surface is another surface of the one reflector.

6. The luminaire optical system according to claim 1, wherein the first optical module, the second optical module, and the third optical module are co-linearly disposed.

7. The luminaire optical system according to claim 1, wherein one of the first optical module, the second optical module, and the third optical module includes a light emitting diode (LED).

8. The luminaire optical system according to claim 1, wherein the one reflector further comprises a third section corresponding to the third optical module, and wherein the first section, the second section, and the third section form a continuously curved portion.

9. The luminaire optical system according to claim 8, wherein the continuously curved portion is substantially shaped according to letter "S".

10. The luminaire optical system according to claim 1, wherein the first planar reflective surface is substantially parallel to the first direction.

11. The luminaire according to claim 1, wherein the second planar reflective surface is substantially parallel to the first direction.

12. The luminaire optical system according to claim 1, wherein the first direction is a nadir direction.

13. The luminaire optical system according to claim 1, wherein the reflector, the first reflective surface, and the third reflective surface are concave.

14. The luminaire optical system according to claim 1, further comprising a printed circuit board (PCB) supporting the first optical module, the second optical module, and the third optical module.

15. The luminaire optical system according to claim 14, further comprising a lid and wherein the lid has a radius of curvature such that the light vectors in the first direction, the second direction, and the third direction are orthogonal to the lid.

* * * * *